US005486837A

United States Patent [19]

Miller

[11] Patent Number: 5,486,837

[45] Date of Patent: Jan. 23, 1996

[54] COMPACT MICROWAVE ANTENNA SUITABLE FOR PRINTED-CIRCUIT FABRICATION

[76] Inventor: Lee S. Miller, 105 Windsor Ct., Central, S.C. 29630

[21] Appl. No.: 361,849

[22] Filed: Dec. 21, 1994

Related U.S. Application Data

[63] Continuation of Ser. No. 16,531, Feb. 11, 1993, abandoned.

[51] Int. Cl.[6] ..... H01Q 13/00

[52] U.S. Cl. ..... 343/780; 343/785; 343/797

[58] Field of Search ..... 343/772, 780, 343/781 R, 793, 797, 795, 785, 786, 700 MS; H01Q 13/00

[56] References Cited

U.S. PATENT DOCUMENTS

| | | | |
|---|---|---|---|
| 2,479,209 | 7/1945 | Chu | 343/780 |
| 2,654,842 | 10/1953 | Engelmann . | |
| 3,212,095 | 10/1965 | Ajioka | 343/785 |
| 3,541,559 | 4/1968 | Evans | 343/795 |
| 3,720,953 | 3/1973 | Ajioka | 343/771 |
| 3,945,009 | 3/1976 | Trigon | 343/780 |
| 4,345,257 | 8/1982 | Brunner | 343/780 |

FOREIGN PATENT DOCUMENTS

| | | | |
|---|---|---|---|
| 1386777 | 3/1975 | United Kingdom | 343/780 |

OTHER PUBLICATIONS

P. R. Haddad and D. M. Pozar, "Anomalous Mutual Coupling Between Microstrip Antennas," pp. 1545–1549, IEEE Transactions on Antennas and Propagation, Nov. 1994.

Roger F. Harrington, "Time–Harmonic Electromagnetic Fields," pp. 163–171, McGraw–Hill Book Company, 1961.

SAMS Prentice Hall Computer Publishing, "Reference Data for Engineers: Radio, Electronics, Computer, and Communications," pp. 15–18, Eighth Edition, 1993.

Robert S. Elliott, "Antenna Theory and Design," pp. 99–109, Englewood Cliffs, N.J., 1981.

John Huang, "A Ka–Band Circularly Polarized High–Gain Microstrip Array Antenna" IEEE Transactions on Antennas and Propagation, Vo. 43, No. 1, Jan. 1995.

*Primary Examiner*—Donald T. Hajec
*Assistant Examiner*—Tan Ho
*Attorney, Agent, or Firm*—Dority & Manning

[57] ABSTRACT

A compact microwave antenna suitable of printed-circuit fabrication is comprised of a non-radiating guided wave structure for supporting the propagation of captured surface-guided waves; a series of dipoles in proximity to the guided waves supported by the non-radiating guided wave structure, wherein such dipoles are excited by the guided waves, thereby generating a desired radiation field, wherein the dipoles are independent of electrical transmission lines, and wherein the length and spacing of the dipoles are selected to achieve a desired angle of radiation from the surface of the non-radiating guided wave structure and a desired radiation frequency; and excitation means, in communication with the non-radiating guided wave structure, for exciting the reactive medium with electromagnetic waves to generate the captured surface-guided waves.

22 Claims, 2 Drawing Sheets

COMPACT MICROWAVE ANTENNA SUITABLE FOR PRINTED-CIRCUIT FABRICATION

This is a continuation of application U.S. Ser. No. 08/016,531, filed Feb. 11, 1993, which was abandoned upon the filing hereof.

BACKGROUND OF THE INVENTION

The invention relates generally to means for the radiation and reception of electromagnetic signals by an antenna that is compact and suitable for printed-circuit fabrication.

Existing microwave antennas comprise a wide variety of configurations and constructions employed in various applications, such as satellite reception, remote broadcasting, or military applications. Typical of these existing technologies are present-day satellite antennas. These antennas, typically parabolic dishes, are bulky and require vertical extensions at their feed points. They are, consequently, heavy and expensive and require a large set-up area. A second existing technology includes smaller present-day printed-circuit antennas, such as "patch arrays." These antennas require, however, that each element be fed with a transmission line of precise length. The tedious impedance-matching requirements of each element to each feed line increases the complexity of these antennas, thereby tending to inhibit their use.

SUMMARY OF THE INVENTION

The present invention recognizes and addresses the foregoing technical problems and others associated with microwave antennas. Accordingly, it is one general object of the present invention to provide a compact, light-weight microwave antenna suitable for manufacture using printed-circuit techniques.

It is another object of the present invention to provide a microwave antenna suitable for manufacture using printed-circuit techniques, the elements of which do not require electrical inter-connection or connection to any external transmission line. Consequently, it is yet another object to provide such an antenna comprising a series of dipoles in such proximity to a non-radiating guided wave structure supporting guided waves so that said dipoles are excited by said guided waves.

It is a still further object of the present invention to provide a microwave antenna suitable for manufacture using printed-circuit techniques capable of radiation in desired planes or at desired angles from the antenna's aperture.

Additional objects and advantages of the invention will be apparent to those of ordinary skill in the art from the description which follows, or may be perceived by practice of the invention disclosed herewith.

Additionally, it should be further appreciated that modifications and variations to the specifically illustrated and discussed features and methodology, construction, and materials hereof may be practiced in various embodiments and uses of this invention without departing from the spirit and scope thereof, by virtue of present reference thereto, such variations may include, but are not limited to, substitution of equivalent means and features or materials for those shown or discussed, and the functional or positional reversal of various parts, features, or the like.

Still further, it is to be understood that different embodiments of this invention may include various combinations or configurations of presently disclosed features, elements, or their equivalents (including combinations or configurations thereof not expressly shown in the figures or stated in the detailed description).

One presently preferred embodiment relates to a compact microwave antenna suitable for printed-circuit fabrication. The antenna generally comprises a non-radiating guided wave structure configured to support the propagation of captured guided waves; a series of dipoles in proximity to said guided waves supported by said non-radiating guided wave structure, wherein said dipoles are excited by said guided waves, thereby generating a desired radiation field, wherein said dipoles are independent of electrical transmission lines, and wherein the length and spacing of said dipoles are selected to achieve a desired angle of radiation from the surface of said non-radiating guided wave structure and a desired radiation frequency; and excitation device, in communication with said non-radiating guided wave structure, configured to excite said reactive medium with electromagnetic waves to generate said captured surface-guided waves.

The above-referenced presently preferred embodiment makes use of "trapped" or "guided" electromagnetic waves. A wave travelling along, for example, a metallic or dielectric interface may be trapped (i.e. non-radiating) by a reactive surface. This surface may be comprised of a conductor/dielectric, dielectric, corrugated, or other slow-wave, structure. Such a propagating medium comprises a non-radiative structure. When the propagating medium of this presently preferred embodiment is excited by a Transverse Magnetic (TM) wave, there exists an electric field component (E) in the longitudinal direction as is understood in the art. Longitudinally oriented dipole elements arranged proximately to this propagating wave are excited by this E-field, causing them to radiate in a desired direction.

In another presently preferred embodiment of the present invention, the propagating medium is comprised of a conductive sheet in a flat-plate, or planar, form covered by a dielectric surface. The dielectric thickness is chosen to effect reinforcement of the desired radiation in a desired direction. For broadside radiation, for example, the dielectric thickness required is one-quarter of the radiation's wavelength. Additionally, the dielectric need not be homogenous; it could consist of a dense substrate and a lower density boundary and sheet containing the dipoles.

In this presently preferred embodiment, a suitable plane-wave source is used to excite the guided wave medium. This source may be, for example, a pillbox antenna as is known in the art, but any antenna capable of collimating or focusing an electromagnetic wave in one plane will suffice. Other such antennas include, for example, sectorial horns (with or without lens correction), printed-circuit patch arrays, waveguide-slotted arrays, or any other array antenna.

In this presently preferred embodiment, the dielectric surface is covered by an array of, for example, approximately one-half wavelength dipoles. By suitably choosing the length and spacing of these dipoles (or scatterers), the radiated field is established in the desired direction. If the dipoles are non-resonant, the impedance is reactive and the coupled energy is controllable, in accordance with well-known theory. By properly choosing dipole length, width, and spacing, the radiated energy reinforces in the intended direction and the desired amplitude distribution is effected. Thus, the mainlobe and sidelobe diffraction characteristics can be accurately controlled.

In another presently preferred embodiment, dipoles may be orthogonally coupled, resulting in a series of crossed dipoles and allowing both planes of polarization to be radiated. Such a configuration consequently requires that the propagating medium be excited by orthogonal waves. With such dual polarization realization, the two signals may be combined and phased to produce circular or elliptical polarization states.

Those of ordinary skill in the art will appreciate that various geometries may be employed within the scope and spirit of the present invention to produce various desired radiation patterns. Accordingly, for example, another presently preferred embodiment of the present invention comprises a non-radiating guided wave structure of a cylindrical shape, such as is typically employed in Goubau lines or in the construction of polyrod antennas. Placement of dipoles on or near the surface of this structure causes radiation which is dependent on the particular mode of the wave propagating in the non-radiating guided wave structure. Radiation may be generated which is azimuthally isotropic and directive in the transverse plane, depending on the propagation mode of the excitation wave. Such a configuration may generally provide omnidirectional radiation in one plane and could be used, for example with vertical orientation, to provide omnidirectional coverage in the earth plane and directivity in the vertical plane, such as is needed in broadcast service.

The foregoing objects, features, and aspects of the present invention are discussed in greater detail below, in the Detailed Description portion of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

DETAILED DESCRIPTION OF THE PREFERRED EMBODIMENTS

Reference will now be made in detail to various presently preferred embodiments of the invention, examples of which are illustrated in the accompanying drawings. Such examples are provided by way of explanation of the invention, not limitation of the invention. In fact, it will be apparent to those skilled in the art that various modifications and variations can be made in the present invention without departing from the scope or spirit of the invention. Thus, it is intended that the present invention cover such modifications and variations that come within the scope of the appended claims and their equivalents.

As referenced above, certain objects of the present invention are concerned with providing a compact microwave antenna suitable for printed circuit fabrication without the need for individual feed lines to individual antenna elements.

Figure 1:
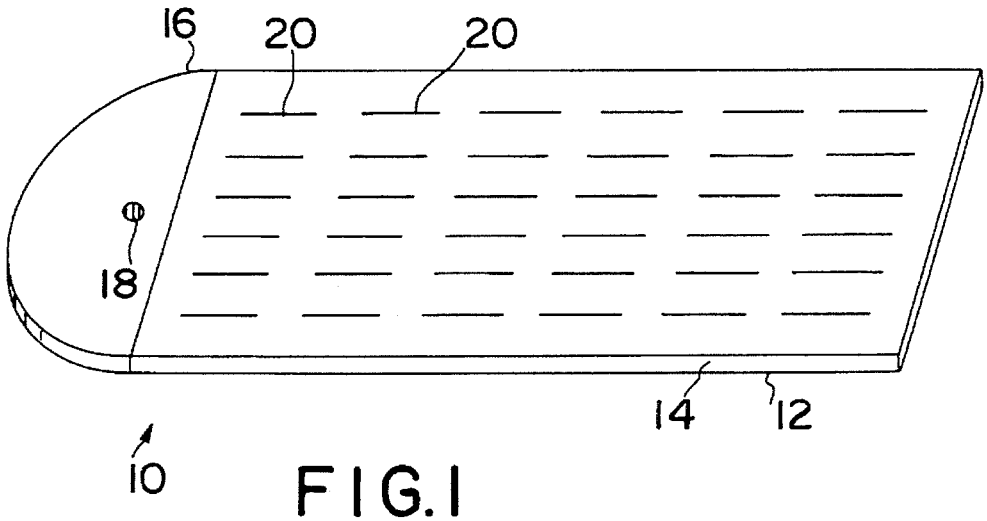
FIG. 1 is a perspective view of the general elements comprising one preferred embodiment of the present invention.

Accordingly, one preferred embodiment of the present invention is represented generally in FIG. 1. Antenna 10 is comprised generally of a conducting plate 12, supporting dielectric surface 14 fed by pillbox antenna 16. Pillbox antenna 16 is fed by a transmission line (not shown) at 18. Dipole elements 20 are located proximately to dielectric surface 14 so that, when excited by a surface-guided wave propagating in dielectric surface 14, a desired radiation pattern is generated.

As discussed in the Summary of the Invention, pillbox antennna 16 serves to excite dielectric 14 with a collimated or focused electromagnetic wave. It is understood that any device capable of launching such a wave in a non-radiating guided wave structure is encompassed within the scope and spirit of the invention. It is furthermore understood that various methods of affixing dipole elements 20 to a position proximate to dielectric 14 may be employed. For example, dipole elements 20 may be physically embedded upon the surface of dielectric surface 14. It is, however, an aspect of this presently preferred embodiment to employ a printed surface, such as a polyester film such as MYLAR (manufactured by DuPont) supporting metallized dipoles. It is also understood that there might arise applications requiring an approximation of free space between dipole elements 20 and dielectric surface 14, for example when very large arrays are used, resulting in weak excitation of the elements. In these applications, it may be desirable to employ very thin films or styrofoam in positioning dipole elements 20. Any of these or other equivalent means of positioning dipole elements 20 are, therefore, encompassed within the scope of the present invention.

A TM wave launched by pillbox antenna 16 in dielectric surface 14 contains a longitudinal component of the associated electric field which excites longitudinally oriented dipole elements 20, which then radiate the energy in a definable radiation pattern. Length, width, and position of the dipoles 20 are chosen to effect the desired phase and amplitude distribution at the dipole array interface. This distribution determines the characteristics of the diffracted radiation pattern. Position of the dipoles 20, in conjunction with the slow-wave (or velocity retardation) properties of the dielectric, inhibit radiation in other directions. That is, the dipoles 20 may be spaced less than, for example, one free-space wavelength to avoid "grating" lobes.

As is understood in the art, dipoles 20 will also generate a radiation pattern into dielectric surface 14, which will be reflected from conducting plate 12. This reflected pattern will either interfere with or reinforce the oppositely radiated patern. Thus, the dielectric thickness is chosen to effect reinforcement of the desired radiation in a desired direction. For broadside radiation, for example, the dielectric thickness required is one-quarter of the radiation's wavelength. It will be understood by those of ordinary skill in the art that various dielectric thicknesses may be employed and that another embodiment of the present invention could include a dielectric surface 14 not supported by conducting plate 12 and that in such a configuration, a series of dipole elements could be situated on the opposite side of dielectric surface 14.

With respect to the presently preferred embodiment illustrated in FIG. 1, it is desired to excite dielectric surface 14 with the lowest order TM mode. It is understood, however, that higher order modes, generating electric fields in the transverse direction, could be employed, allowing an additional dipole array for excitation by those additional fields.

Figure 2:
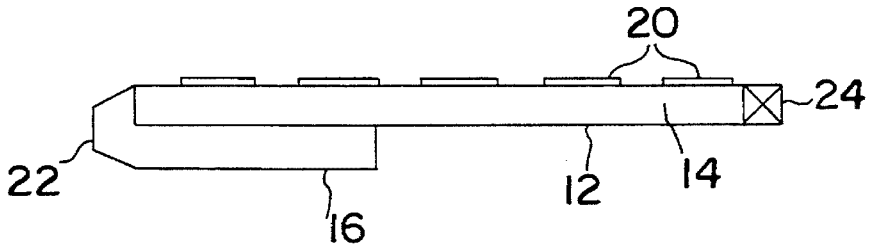
FIG. 2 is a cross-sectional view of a presently-preferred embodiment of the present invention.

Referring now to FIG. 2, a cross-sectional view of another presently preferred embodiment of the present invention is presented. In this embodiment, pillbox antenna 16 is located on the reverse side of conducting plate 12 to create a more compact structure. The energy radiated from pillbox antenna 16 is guided to the front of dielectric surface 14 by mitered bend 22, which is comprised of an open region bounded by a conducting material. Absorbing element 24 absorbs any energy not radiated by dipole elements 20. Typically, the absorbed energy is 10 per-cent or less that of the radiated energy.

Figure 3:
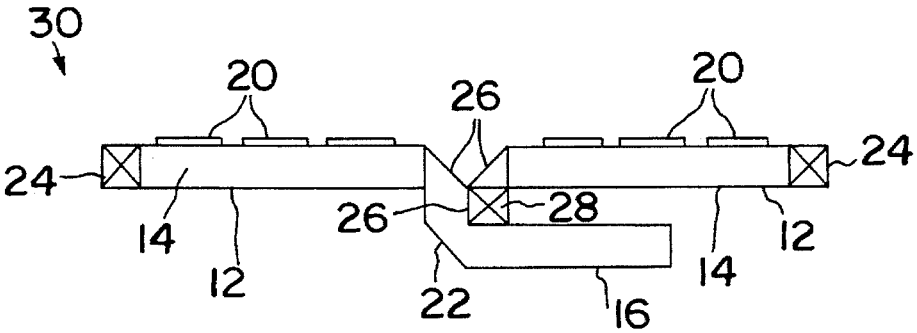
FIG. 3 is a cross-sectional view of another presently preferred embodiment of the present invention, particularly depicting a center-fed array structure.

Referring now to FIG. 3, a cross-sectional view of another presently preferred embodiment is illustrated, depicting a center-fed configuration. In this embodiment, pillbox antenna 16 radiates energy that is guided by mitered bend 22 to septum/reflector 26. Septum/reflctor 26 divides and directs the energy equally to each dielectric surface 14. Phase-shifting device 28 causes each side of the antenna 30 to be illuminated in phase. The center-fed configuration of antenna 30 permits the use of shorter dielectric surfaces 14, that are correspondingly less frequency sensitive, and facilitates formation of a desired amplitude distribution.

Figure 4:
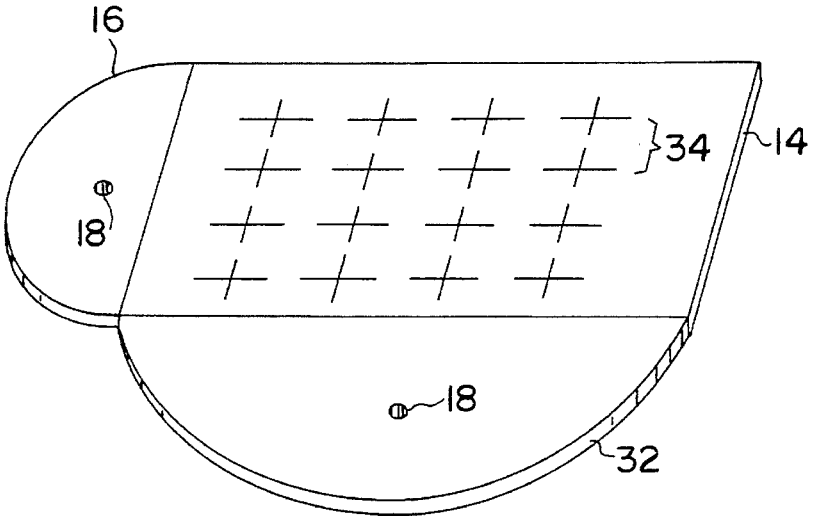
FIG. 4 is a perspective view of another presently preferred embodiment of the present invention, particularly illustrating a crossed-dipole configuration.

Referring now to FIG. 4, yet another presently preferred embodiment of the present invention is presented. This embodiment is comprised generally of the elements illustrated in FIG. 1, with an additional pillbox on the side face of dielectric surface 14 and a series of crossed dipole elements 34 replacing dipole elements 20 as in FIG. 1. When pillbox antennas 16 and 32 excite dielectric surface 14 with orthogonal TM waves, both planes of polarization are radiated. With such dual polarization realization, the two signals may be combined and phased to produce circular or elliptical polarization states.

Figure 5:
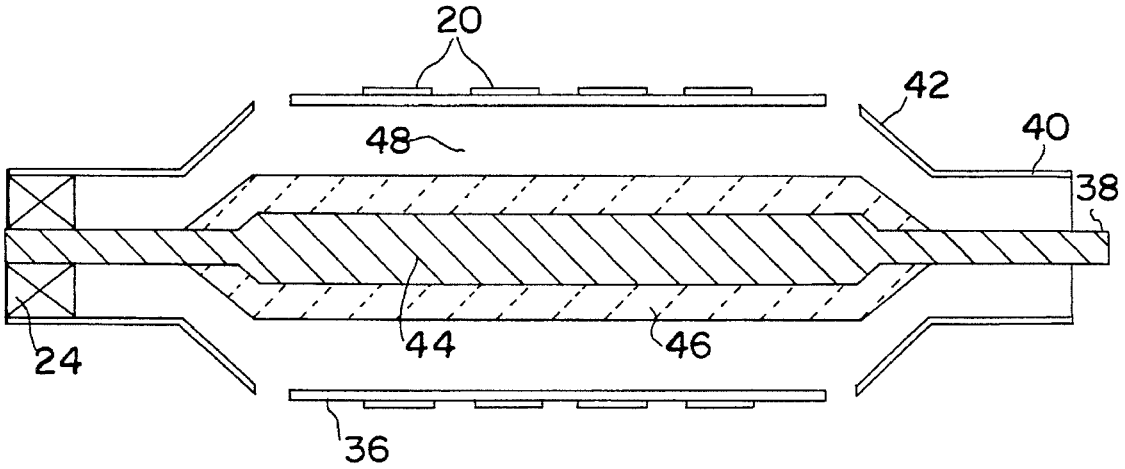
FIG. 5 is a cross-sectional view of yet another presently preferred embodiment, illustrating an azimuthally omnidirectional coaxial-line driven antenna.

Another presently preferred embodiment of the present invention comprising a non-radiating guided wave structure of a cylindrical shape is depicted in FIG. 5. FIG. 5 illustrates a what is referred to in the art as a Goubau line, a non-radiating transmission line typically used in place of coaxial cable to feed antennas, surrounded by low-density dielectric membrane 36 supporting dipole elements 20. The antenna is fed by a coaxial cable comprised of inner conductor 38 and outer conductor 40. A conical transition region 42 provides impedance matching between the feed line and downstream Goubau line structure, comprising inner conductor 44 and dielectric cladding 46. Dipoles 20, supported by low-density dielectric membrane 36, may be excited by an electromagnetic wave propagating in the Goubau line, thereby radiating a desired radiation pattern. In FIG. 5, air space 48 separates dielectric cladding 46 and membrane 36. The employment of air space 48 is determined by particular transmission needs as will be understood by those of ordinary skill in the art. It is understood that varying separation distances or no separation distance may be used. Absorbing element 24 absorbs any energy not radiated by dipole elements 20.

Dipole elements 20 generate a radiation pattern that is omnidirectional in a transverse plane. Such radiation is dependent on the particular mode of the wave propagating in the Goubau line. Radiation may be generated which is azimuthally isotropic and directive in the transverse plane, depending on the propagation mode of the excitation wave. Such a configuration may generally provide omnidirectional radiation in one plane and could be used, for example with vertical orientation, to provide omnidirectional coverage in the earth plane and directivity in the vertical plane.

While various particular embodiments of the invention have been described and shown, it will be understood by those of ordinary skill in the art that the present invention is not limited thereto, since many modifications may be made, as noted in above and in the Summary of the Invention. For example, other non-radiating guided wave structures might be employed, such as corrugated conductors. Therefore, it is contemplated and intended to cover any and all such embodiments as may fall within the scope of the invention as defined by the appended claims.

As another realization, a cylindrical dielectric may be used to effect a guided wave. Placement of dipoles on the surface then causes radiation. Such radiation can be caused to be isotopic in cross-section and directive in the other plane, by excitation of a propagating mode that is symmetric in cross-section. Such an antenna could be used, with vertical orientation, to provide omnidirectional coverage in the earth plane and directivity in the other plane; for uses such as broadcast service.

In the above discussion, use of a pillbox launching device was discussed. Other devices, such as a lens-corrected sectorial horn could be used. Also, with the dual polarization realization, the two signals may be combined and phased to produce circular or elliptical polarization states.

To those skilled in the art, many variations and modifications of the present invention are possible based on the above teachings. It is therefore to be understood that the present invention can be practiced otherwise than as specifically described herein and still will be within the spirit and scope of the appended claims.

I claim:

1. A compact microwave antenna suitable for printed-circuit fabrication, comprising:

a guided wave structure supporting the propagation of surface guided waves;

a series of dipoles disposed relative to the surface of said guided wave structure, wherein said dipoles are excited by surface guided waves propagated along said guided wave structure, thereby generating a desired radiation field, and wherein the length and spacing of said dipoles are selected to achieve a desired angle of radiation from the surface of said guided wave structure and a desired radiation frequency; and an excitation device disposed adjacent to said guided wave structure for exciting said guided wave structure with electromagnetic waves to generate surface guided waves so excite said series of dipoles.

2. The compact microwave antenna suitable for printed-circuit fabrication as in claim 1, wherein said excitation device is additionally configured to receive guided waves from said guided wave structure and wherein said guided waves result from an external excitation of said series of dipoles.

3. The compact microwave antenna suitable for printed-circuit fabrication as in claim 1, wherein said guided wave structure is comprised of a dielectric material.

4. The compact microwave antenna suitable for printed-circuit fabrication as in claim 3, wherein said dipoles are fixed on a fabricated surface supported by said guided wave structure.

5. The compact microwave antenna suitable for printed-circuit fabrication as in claim 1, wherein said dipoles are fixed on a fabricated surface supported by said guided wave structure.

6. The compact microwave antenna suitable for printed-circuit fabrication as in claim 1, wherein said guided wave structure is comprised of a cylindrically-shaped reactive medium.

7. The compact microwave antenna suitable for printed-circuit fabrication as in claim 6, wherein said excitation device is additionally configured to receive guided waves from said guided wave structure and wherein said guided waves result from the external excitation of said series of dipoles.

8. The compact microwave antenna suitable for printed-circuit fabrication as in claim 6, wherein said cylindrically-shaped reactive medium is comprised of a dielectric material.

9. The compact microwave antenna suitable for printed-circuit fabrication as in claim 8, wherein said dipoles are fixed on a fabricated surface supported by said guided wave structure.

10. The compact microwave antenna suitable for printed-circuit fabrication as in claim 6, wherein said dipoles are fixed on a fabricated surface supported by said guided wave structure.

11. A compact microwave antenna suitable for printed-circuit fabrication, comprising:

a reactive medium slab supporting the propagation of surface guided waves;

a series of crossed dipoles disposed relative to the surface of said reactive medium slab, wherein said dipoles are excited by surface guided waves propagated along said reactive medium, thereby generated a desired radiation field, and wherein the length and spacing of said dipoles are selected to achieve a desired angle of radiation from the surface of said reactive medium slab and a desired radiation frequency; and an excitation device disposed relative to the surface of said reactive medium for exciting said reactive medium with electromagnetic waves to generate orthogonal guided waves to excite said series of crossed dipoles.

12. The compact microwave antenna suitable for printed-circuit fabrication as in claim 11, wherein said excitation device is additionally configured to receive guided waves from said reactive medium slab and wherein said guided waves result from an external excitation of said series of dipoles.

13. The compact microwave antenna suitable for printed-circuit fabrication as in claim 11, wherein said reactive medium slab is supported by a conducting plate.

14. The compact microwave antenna suitable for printed-circuit fabrication as in claim 13, wherein said reactive medium is comprised of a dielectric material.

15. The compact microwave antenna suitable for printed-circuit fabrication as in claim 11, wherein said reactive medium is comprised of a dielectric material.

16. The compact microwave antenna suitable for printed-circuit fabrication as in claim 15, wherein said dipoles are fixed on a fabricated surface supported by said reactive medium slab.

17. The compact microwave antenna suitable for printed-circuit fabrication as in claim 11, wherein said dipoles are fixed on a fabricated surface supported by said reactive medium slab.

18. A compact microwave antenna suitable for printed-circuit fabrication, comprising:

a reactive medium slab supporting the propagation of surface guided waves;

a series of dipoles disposed relative to the surface of said reactive medium slab, wherein said dipoles are excited by surface guided waves propagated along said reactive medium slab, thereby generating a desired radiation field, and wherein the length and spacing of said dipoles are selected to achieve a desired angle of radiation from the surface of said reactive medium slab and a desired radiation frequency; and an excitation device disposed adjacent to said reactive medium slab for exciting said reactive medium slab with electromagnetic waves to generate surface guided waves to excite said series of dipoles.

19. The compact microwave antenna suitable for printed-circuit fabrication as in claim 18, wherein said excitation device is additionally configured to receive guided waves from said reactive medium slab and wherein such guided waves result from an external excitation of said series of dipoles.

20. The compact microwave antenna suitable for printed-circuit fabrication as in claim 18, wherein said reactive medium slab is supported by a conducting plate.

21. The compact microwave antenna suitable for printed-circuit fabrication as in claim 18, wherein said reactive medium slab is comprised of a dielectric material.

22. The compact microwave antenna suitable for printed-circuit fabrication as in claim 18, wherein said dipoles are fixed on a fabricated surface supported by said reactive medium slab.

* * * * *